United States Patent [19]

Broxton

[11] Patent Number: 5,009,341

[45] Date of Patent: Apr. 23, 1991

[54] DECORATIVE CONDIMENT SHAKERS

[75] Inventor: Peter A. Broxton, Uppingham, England

[73] Assignee: Loncraine Broxton & Partners Limited, England

[21] Appl. No.: 398,900

[22] Filed: Aug. 28, 1989

[51] Int. Cl.[5] ..... A47G 19/24

[52] U.S. Cl. ..... 222/130; 222/142.1; 222/480; 220/DIG. 13; D7/590; D7/594; D7/595; D7/599

[58] Field of Search ..... 222/130, 142.1, 142.3, 222/142.5, 457.5, 480, 565, 575, 196.1-196.5; D7/52, 54, 56, 55, 590, 594, 595, 599; 220/DIG. 13

[56] References Cited

U.S. PATENT DOCUMENTS

| | | | |
|---|---|---|---|
| 397,103 | 2/1889 | Ayer | 222/196.1 |
| 979,500 | 12/1910 | Isbell | 222/196.1 |
| 2,666,554 | 1/1954 | Murray | 222/565 X |

*Primary Examiner*—David H. Bollinger
*Attorney, Agent, or Firm*—King & Schickli

[57] ABSTRACT

A decorative condiment shaker is provided for holding and dispensing seasonings such as salt and pepper. The shaker includes a body member having a base and integral condiment container. A top includes a fastening ring for engaging the container. A decorative ring is mounted about the condiment container. The ring is held in position by engagement with bearing edges of the base and top. Preferably, the ring is hollow and transparent. Ornamental objects, such as glitter, may be provided in a liquid contained in the ring.

7 Claims, 2 Drawing Sheets

DECORATIVE CONDIMENT SHAKERS

TECHNICAL FIELD

The present invention relates generally to condiment shakers such as for storing and dispensing food seasonings. More particularly, these unique shakers include interchangeable decorative rings so that the shakers may be tailored to match the particular tableware decor or occasion.

BACKGROUND OF THE INVENTION

There is a great deal of interest in shakers for dispensing condiments such as salt and pepper. Many people amass large collections of unique salt and pepper shakers. Others not interested in collecting salt and pepper shakers still typically purchase a number of shaker sets to match different tablecloths and/or tableware and to use for different occasions such as Christmas.

The present invention relates to unique condiment shakers with interchangeable decorative rings that may be purchased and utilized to match any table setting or that are appropriate for any festive holiday occasion. The condiment shakers of the present invention are also unique conversation pieces to be valued by collectors.

SUMMARY OF THE INVENTION

Accordingly, it is a primary object of the present invention to provide condiment pots or shakers of simple construction that are inexpensive to produce yet provide an aesthetically pleasing appearance.

Another object of the present invention is to provide decorative condiment shakers of contemporary styling that are conversation pieces valued by collectors.

Still another object of the present invention is to provide condiment shakers for, for example, salt and pepper, that include interchangeable decorative rings so that the shakers may be matched for use with any tablecloth and/or tableware as well as for use during any special occasion such as birthdays, Valentine's Day, Easter and Christmas.

Additional objects, advantages, and other novel features of the present invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, improved condiment shakers are provided for holding and dispensing such condiments as, for example, salt and pepper. A decorative shaker of the present invention includes a body member having a base and integral cylinder or barrel for holding the condiment. A snap-on top is provided for sealing the condiment barrel. Additionally, a decorative ring is mounted concentrically about the condiment barrel and held in position by engagement with opposed bearing edges of the base and top.

Preferably, both the base and top include a substantially convex outer peripheral face. As such, the shaker has contemporary styling and provides an interesting rocking motion when placed down on a table top.

The decorative ring is preferably hollow and transparent. Ornamentation of various types may be provided within the decorative ring. For example, the decorative ring may be filled with a liquid such as water. Ornamentation in the form of glitter, of substantially any color or colors, or small plastic objects of various shapes and designs may be provided in this water. Preferably, the glitter and ornamental shapes display some buoyancy in the water so as to display movement and an interesting swirling effect as the shaker is moved during use.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modifications in various, obvious aspects, all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
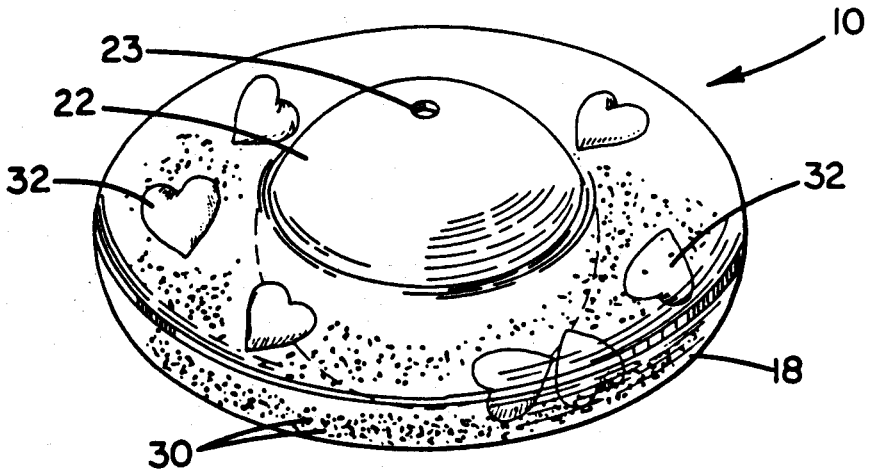
FIG. 1 is a perspective view of an individual decorative condiment shaker of the present invention.
Figure 2:
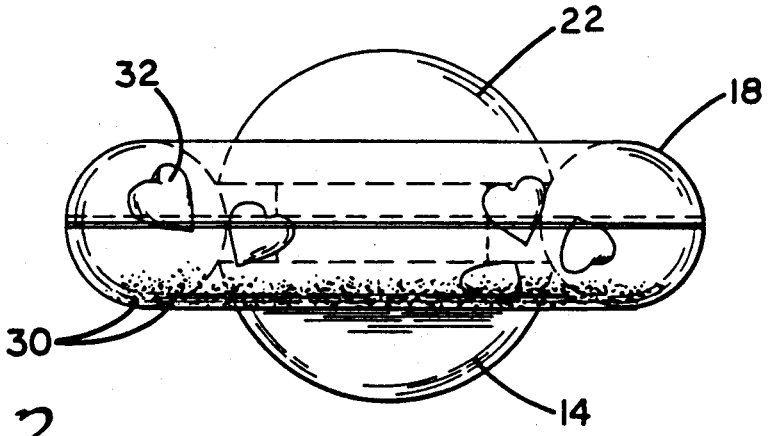
FIG. 2 is a side elevational view of the condiment shaker shown in FIG. 1.
Figure 3:
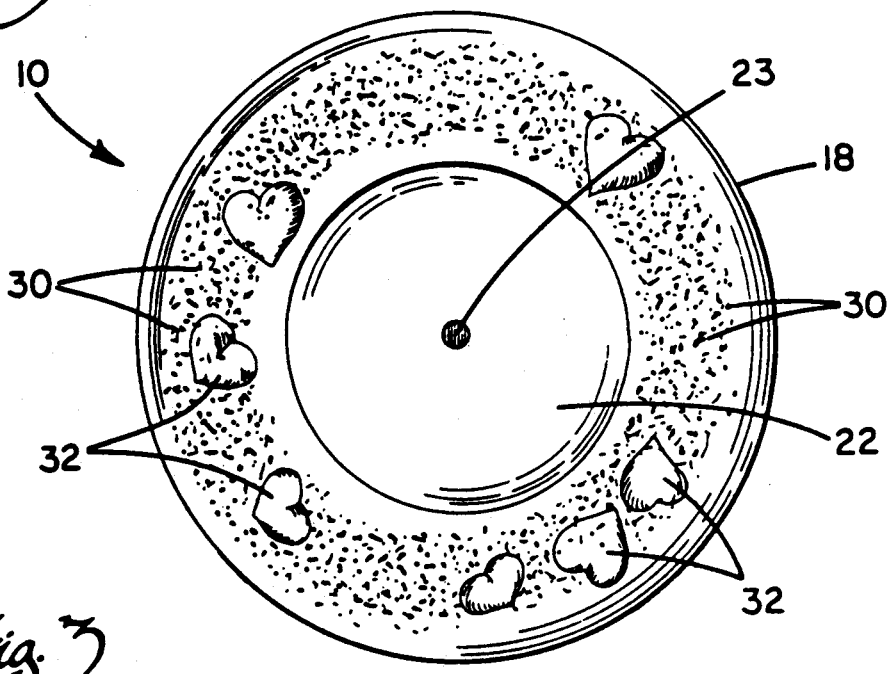
FIG. 3 is a top plan view of the shaker.
Figure 4:
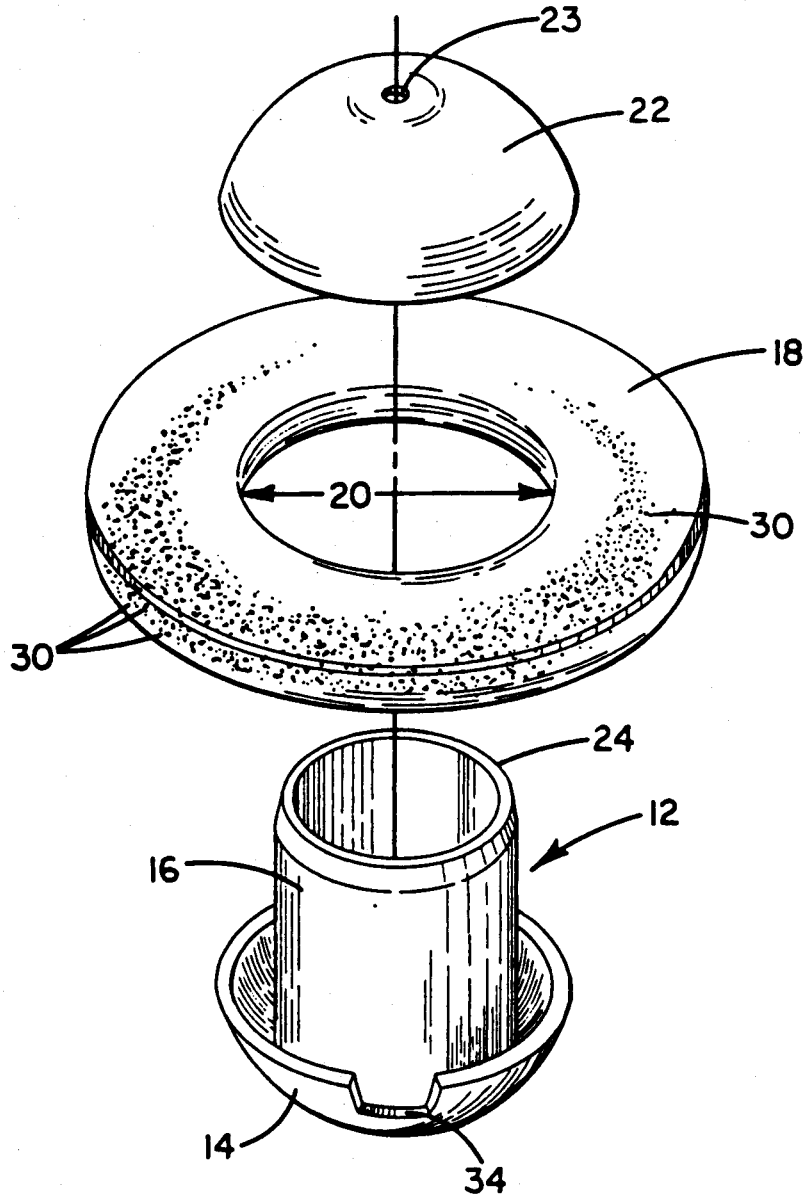
FIG. 4 is an exploded perspective view of the shaker.

Reference is now made to FIGS. 1-5 showing the condiment shaker 10 of the present invention. As shown in FIG. 4, the condiment shaker 10 includes a body member 12 including a base 14 and integral cylindrical condiment container or barrel 16. This barrel 16 is filled with a condiment such as pepper when preparing the shaker for use.

The shaker 10 also includes a decorative ring 18. The ring 18 includes a central opening 20 adapted to be received over and around the condiment barrel 16. A top 22, including a condiment dispensing hole 23, is then snapped over the upper or leading edge 24 of the barrel 16 so as to close the barrel and retain the decorative ring 18 in position.

Figure 5:
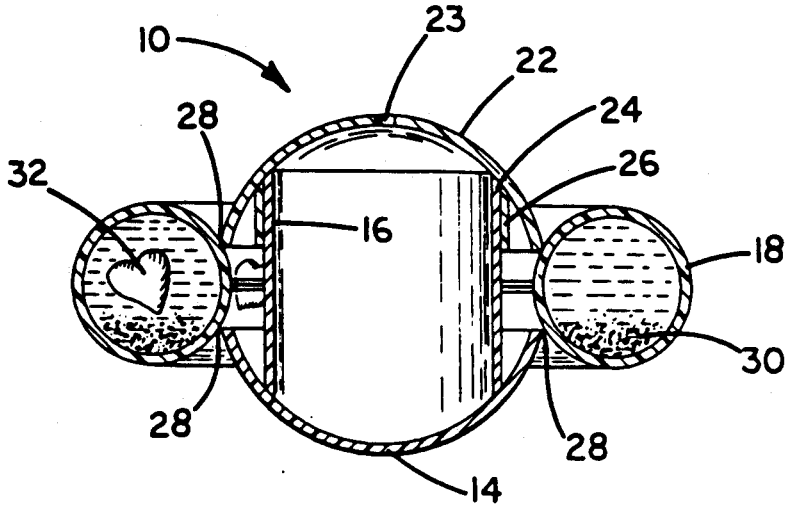
FIG. 5 is a cross-sectional view of the shaker shown in FIG. 1.

As best shown in FIGS. 4 and 5, the top 22 includes a barrel fastening ring 26 adapted for tight engagement around the outer peripheral surface of the barrel 16. Preferably, the leading edge 24 of the barrel 16 is beveled so that the barrel fastening ring 26 may be more easily received about the barrel.

Once the top 22 is fully engaged about the barrel 16, it should be appreciated that opposing bearing edges 28 of the top and base 14 engage the decorative ring 18 so as to firmly hold it in position. Additionally, since both the base 14 and top 22 include matching convex outer peripheral faces, the shaker 10 has a uniquely rounded, contemporary design. Advantageously, the elimination of any squared surfaces significantly enhances the aesthetic appeal of the shaker 10.

As shown, the decorative ring 18 may be made both transparent and hollow. Preferably, such a hollow ring 18 is filled with a liquid such as water. Ornamentation such as glitter and/or other objects of unique shapes may be provided in the liquid within the ring 18. For example, small ornamental plastic objects 32 in the shape of hearts are shown in the drawing figures. Such a decorative ring 18 including hearts 32 is particularly adapted for use in February around the time of Valentine's Day. In accordance with one aspect of the present invention, other interchangeable decorative rings 18 may include uniquely shaped objects appropriate for utilization for other special occasions. For example, a ring including a small plastic bunny and a number of Easter eggs could be provided for utilization at Easter. Additionally, a ring including a small plastic Santa Claus and Christmas trees or gifts could be provided for utilization at Christmas.

The decorative rings 18 may be quickly changed when desired. More particularly, a notch 34 is provided in the base 18. This notch 34 may be engaged with the thumb or an eating utensil such as a fork, spoon or knife so as to allow the application of pressure to the base 14 of sufficient force to pry the top 22 from the barrel 16. The decorative ring 18 currently on the barrel may then be removed and a new ring 18 positioned thereon. The top 22 is then repositioned over the barrel so as to engage the barrel 16 and ring 18 thereby holding the shaker 10 together.

No matter which interchangeable decorative ring 18 is selected, the convex base 14 serves to promote movement of the ornamentation in the liquid when the shaker 10 is positioned on the table top. As discussed above, the convex base 14 causes the shaker 10 to rock over. This rocking of the shaker 10 induces a swirling motion in the liquid that fills the hollow ring 18. Glitter 30 becomes caught up in this swirling motion to produce a brief display of sparkling color every time the shaker comes to rest on a table top. Thus, it should be appreciated that the convex base promotes a pleasing aesthetic display not possible if the shaker 10 were provided with a flat base.

It should also be appreciated that when the decorative rings 18 are not in use as part of the condiment shakers 10 of the present invention, they may function in some other capacity. For example, the rings 18 may be used as napkin rings or soft boiled egg holders thus further adding to the festive table decoration.

In summary, numerous benefits have been described which result from employing the concepts of the present invention. The condiment shaker of the present invention is a versatile conversation piece that may be adapted through the utilization of interchangeable decorative rings for use at any occasion. Additionally, the shaker may be adapted for use with substantially any tablecloth and tableware with any multitude of color schemes available. The condiment shaker is relatively inexpensive to produce. It is also sufficiently unique so as to be of interest to, for example, salt and pepper shaker collectors.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A decorative condiment shaker, comprising:

a body member including a base and a condiment container;

a removable top for sealing said condiment container;

a hollow and transparent decorative ring mounted about said condiment container and held in position by engagement with said body member and said removable top; and means received within said decorative ring for ornamenting said decorative ring.

2. The decorative condiment shaker set forth in claim 1, wherein said base includes a substantially convex outer peripheral face.

3. The decorative condiment shaker set forth in claim 1, wherein said top includes a substantially convex outer peripheral face.

4. The decorative condiment shaker set forth in claim 1, wherein said decorative ring is filled with liquid and said ornamentation means is glitter.

5. The decorative condiment shaker set forth in claim 1, wherein said ornamentation means is a shapened object.

6. The decorative condiment shaker set forth in claim 1, wherein said top includes a fastening ring for engaging said condiment container.

7. The decorative condiment shaker set forth in claim 1, wherein said base is notched so as to provide an exposed edge for prying said removable top and body member apart to allow the refilling of said shaker with condiment and the changing of said decorative ring.

* * * * *